US010689815B2

(12) United States Patent
Sheckler et al.

(10) Patent No.: US 10,689,815 B2
(45) Date of Patent: Jun. 23, 2020

(54) DEVICE FOR TRANSMITTING THE PRESENCE AND ACTIVITY OF A ROAD CONSTRUCTION FLAGGER

(71) Applicants: Ross David Sheckler, Cato, NY (US); Adam Parker Kovar, Geneva, NY (US)

(72) Inventors: Ross David Sheckler, Cato, NY (US); Adam Parker Kovar, Geneva, NY (US)

( * ) Notice: Subject to any disclaimer, the term of this patent is extended or adjusted under 35 U.S.C. 154(b) by 138 days.

(21) Appl. No.: 15/709,923

(22) Filed: Sep. 20, 2017

(65) Prior Publication Data

US 2019/0085518 A1 Mar. 21, 2019

(51) Int. Cl.

| | |
|---|---|
| ***G09F 7/00*** | (2006.01) |
| ***G08G 1/09*** | (2006.01) |
| ***E01F 9/608*** | (2016.01) |
| ***G08G 1/01*** | (2006.01) |

(52) U.S. Cl.

CPC ..... *E01F 9/608* (2016.02); *G08G 1/0104* (2013.01); *G09F 7/00* (2013.01)

(58) Field of Classification Search

CPC ..... G08G 1/0955; G08G 1/09; G08G 1/104; B60Q 7/00; E01F 9/608; G09F 7/00

USPC ..... 340/908

See application file for complete search history.

(56) References Cited

U.S. PATENT DOCUMENTS

| | | | | |
|---|---|---|---|---|
| 6,288,651 | B1 * | 9/2001 | Souza | E01F 9/688 200/86 A |
| 6,407,675 | B1 * | 6/2002 | Mumford | G08B 5/36 116/63 P |
| 7,109,884 | B2 * | 9/2006 | Glynn | G08G 1/096716 340/433 |
| 7,382,276 | B2 * | 6/2008 | Boss | G08G 1/0962 340/539.1 |
| 8,144,030 | B1 * | 3/2012 | Lipke | G08G 1/095 116/63 R |
| 8,319,662 | B1 * | 11/2012 | Bontemps | G08G 1/0955 340/907 |
| 8,779,935 | B2 * | 7/2014 | Savchenko | B60Q 5/008 324/174 |
| 2001/0054970 | A1 * | 12/2001 | Jones | G08G 1/0955 340/915 |
| 2004/0178928 | A1 * | 9/2004 | Butzer | G08G 1/095 340/908 |
| 2007/0222640 | A1 * | 9/2007 | Guelzow, II | G08B 5/006 340/908 |
| 2010/0188245 | A1 * | 7/2010 | Nielsen | G01V 3/08 340/686.1 |
| 2011/0191058 | A1 * | 8/2011 | Nielsen | B65D 83/203 702/130 |
| 2014/0097970 | A1 * | 4/2014 | Ethington | G09F 13/00 340/908 |
| 2015/0054660 | A1 * | 2/2015 | Simmons | B60Q 1/46 340/908 |
| 2016/0159277 | A1 * | 6/2016 | Simmons | B60Q 1/46 340/908 |

* cited by examiner

*Primary Examiner* — Albert K Wong

(57) ABSTRACT

The handle of the flagger's stop paddle is combined with computing and communications technologies so that the presence of the road construction flagger can be established and the details of the flagger's efforts to manage traffic flow through the construction site can be transmitted to traffic management centers.

6 Claims, 3 Drawing Sheets

DEVICE FOR TRANSMITTING THE PRESENCE AND ACTIVITY OF A ROAD CONSTRUCTION FLAGGER

CROSS REFERENCE TO RELATED APPLICATION

This application claims the benefit of U.S. Provisional Application No. 62/399,022 filed on Sep. 23, 2016, entitled "Device for transmitting the presence and activity of a road construction flagger".

BACKGROUND OF THE INVENTION

The present invention relates to the generation of data records for traffic information systems. The invention serves the purpose of automating the transmission of worker location and activity allowing traffic information systems to represent the activity of workers directing traffic and/or pedestrians in and around roadways.

The operation of the modern highway system and its navigation requires precise information on the presence and the activities of construction workers. Current highway operations in many of the United States require only the roughest reports on where workers are active. These processes generally require the workers to schedule work in advance and place a phone call to the transportation agency as a means of reporting. Such phone calls tend to be forgotten or ignored and are not used to update changes in location as work progresses. As a result, the transportation agency's traffic management centers generally have little data on the activities of flaggers and other workers.

The invention embeds an electronic controller and radio, or modem, into the handle of the stop paddle. The handle may be short as in a crossing guard's stop sign, or it may be a long pole, or a section of a collapsible pole, that can rest on the ground as in a construction application. By including the reporting capability into the traffic control apparatus, the stop paddle, the task of tracking flagging activity is reduced to the flip of a switch and minute-by-minute updates of work location and status happen without effort on the part of the worker. Examples of the implementation of the electronics in various stop paddles are shown in FIG. 1.

SUMMARY OF THE INVENTION

The invention is a single device which can act both as a visual sign, such as an octagonal stop sign, and as an information system transmitting the flagger's activities to data centers. By integrating the data recording and transmission system into the sign the process of reporting flagging activities is significantly simplified and the ability to transmit real-time worker activity to vehicle navigation systems is created.

The invention is a handle, or portion of a collapsible handle, for a road construction worker's stop paddle which incorporates the electronic systems that are capable of recording the location and activity of the flagger (FIG. 1). The device has the additional capability of transmitting the recorded data to remote traffic data centers.

As a system with a data center that is properly constituted, the device can inform vehicles of the flagger's presence many miles from the flagger. Major commercial navigation systems actively collect road work data from traffic centers so that a data relayed from the work zone to the appropriate traffic centers is automatically relayed to drivers in a matter of minutes. FIG. 2 shows a process flow diagram for the data system which relays the information generated by the invention to the navigation system of automobiles.

FIG. 3 shows one possible manifestation of the invention. The invention consists of (A) an electronic circuit board with processor, geo-location capability and radio, (B) a rechargeable or replaceable battery, (C) a switch to activate the device, (D) in some instances a switch to note a change in status [e.g. from STOP to SLOW], (E) possibly a switch to record other events such as counting the number of vehicles that pass, all of which are housed in a handle, or section of a handle (F) of a sign.

In the field the worker takes the invention, which looks like an ordinary STOP/SLOW sign, to the work position. When the process of controlling traffic is to begin the power is switched on (C). The circuit board determines the sign's location and transmits the device identifier and location to the traffic management center. As the worker switches the sign from STOP to slow the status switch (D) is changed and the amount of time in either the STOP or SLOW position is recorded internally in the device. Periodically, every ten minutes or so, the record of STOP and SLOW times are transmitted to the traffic management center so that the traffic delay can be noted. In some renditions of the device and under some rules of operations the flagger may cycle switch (E) to record each vehicle which passes the position. If the flagger changes position in the roadway the periodic reporting or motion triggered reporting will transmit the new flagger position to the traffic management center. When the traffic control activity is completed the power switch (C) is turned off and the device transmits the termination of the activity to the traffic management center.

In some renditions of the device one or more cameras may be incorporated in the device to record the activities of the vehicles near the flagging station. The visual record provides a number of values including the management of the flagger or vehicle incident reconstruction.

In a crossing guard application, the device may not have status switch (D) to note the change from 'STOP indicated' to 'SLOW indicated' and may, by being activated, just mark that there is a crossing guard managing traffic.

The circuit board may also include accelerometers to measure forces and magnetometers to measure fluctuations in magnetic fields so that the orientation with respect to the earth's gravitational and magnetic fields can be determined. The data from the accelerometer and magnetometer allow the system to record details such as whether the sign is upright and when it is rotated to change the displayed sign from 'STOP' to 'SLOW'. This ability allows data analysis to detect when the sign has been set down at the end of a job without the 'OFF' switch (C) being pressed. It also allows for the determination of the STOP/SLOW cycle even if the operator neglects to toggle the status switch (D).

BRIEF DESCRIPTION OF THE DRAWINGS

The characteristic features of this invention will be particularly pointed out in the summary of the invention and the claims, the invention itself and manner in which it may be made and used may be better understood after a review of the accompanying drawings.

Figure 1:
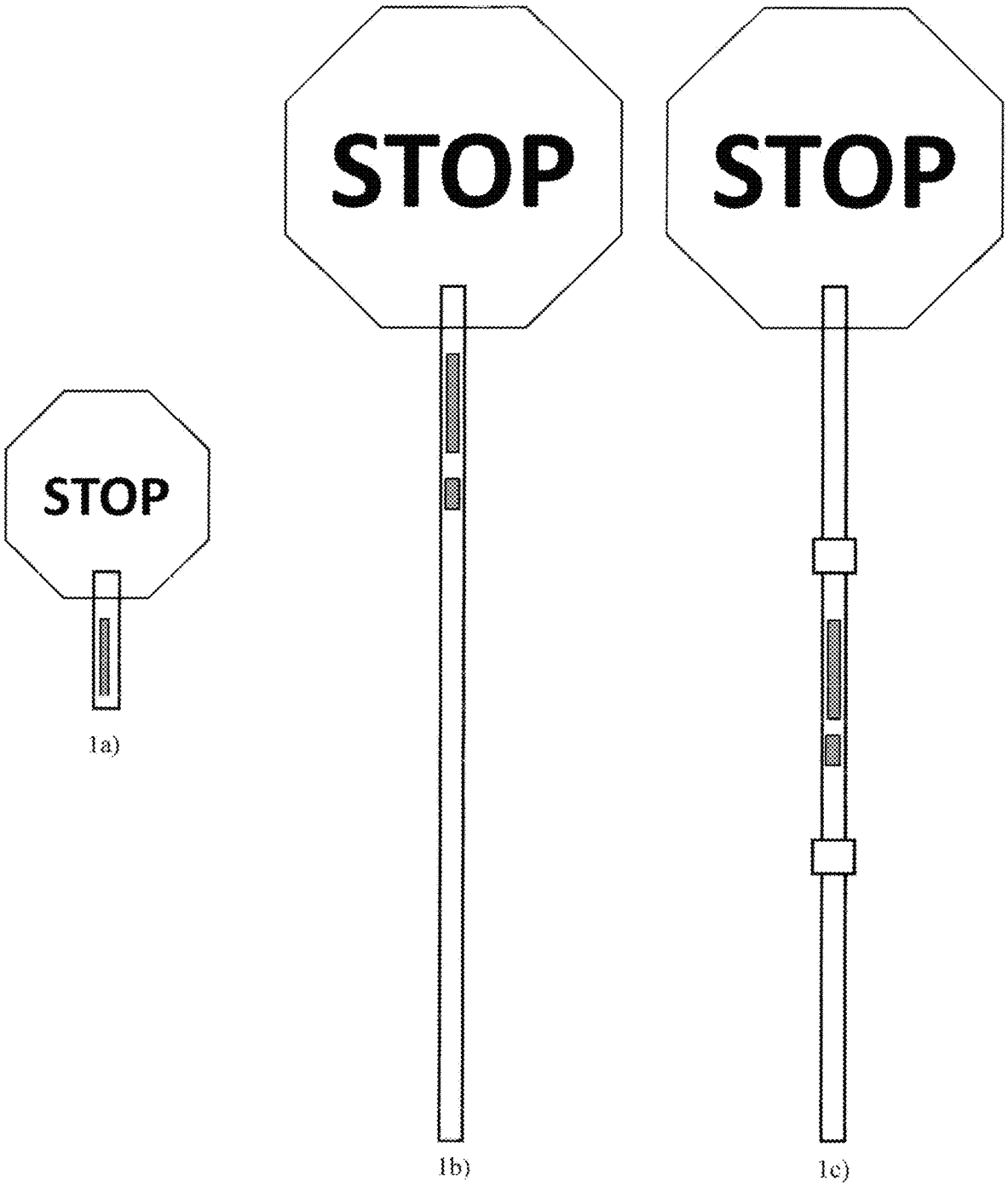
FIGS. 1*a*, 1*b*, 1*c* shows the invention in several possible configurations where the electrical components are symbolized by the gray shaded blocks.
Figure 2:
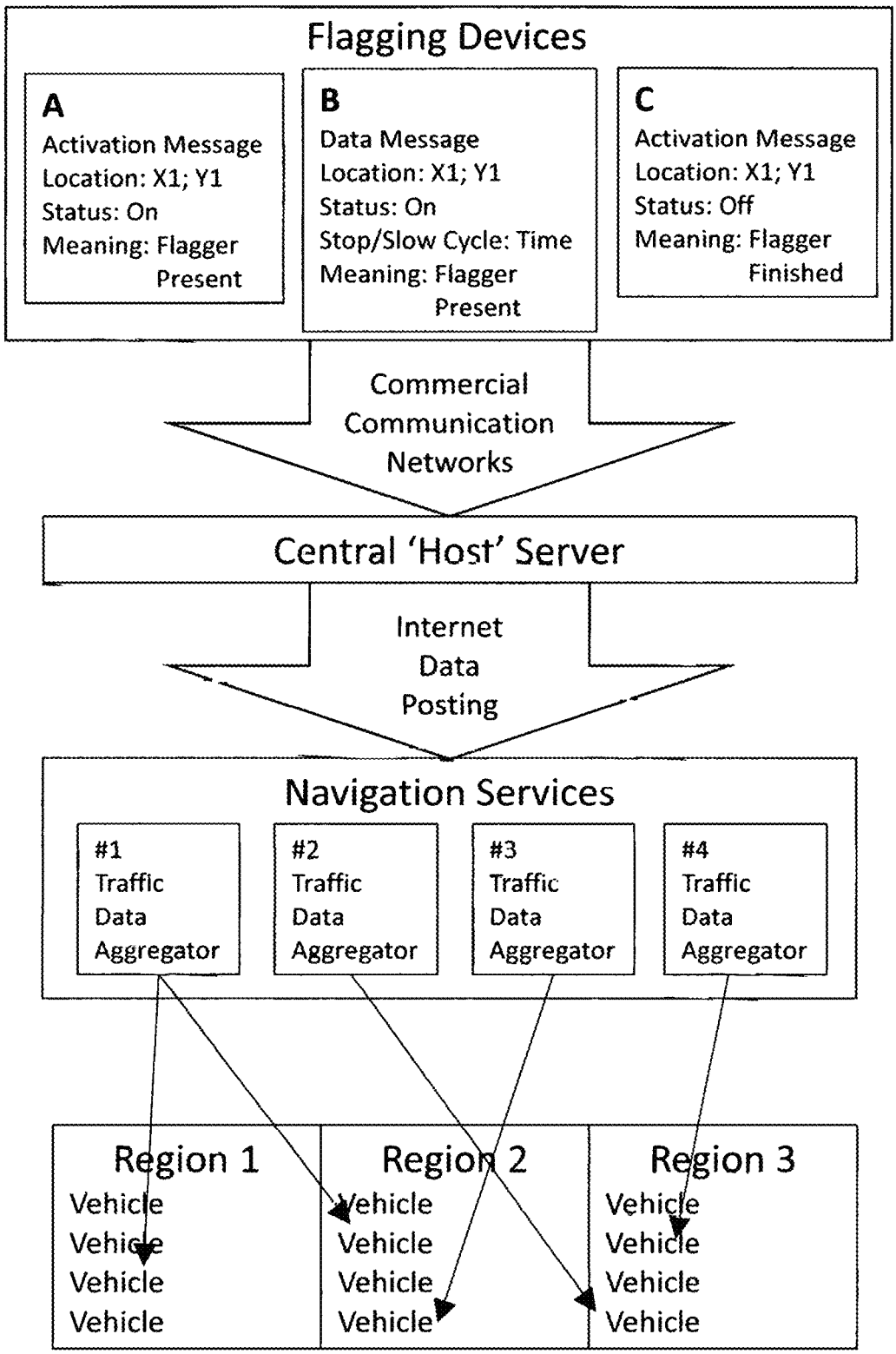
FIG. 2 shows a system flow diagram in which the invention works with information systems to relay worker information to the navigation systems of automobiles.
Figure 3:
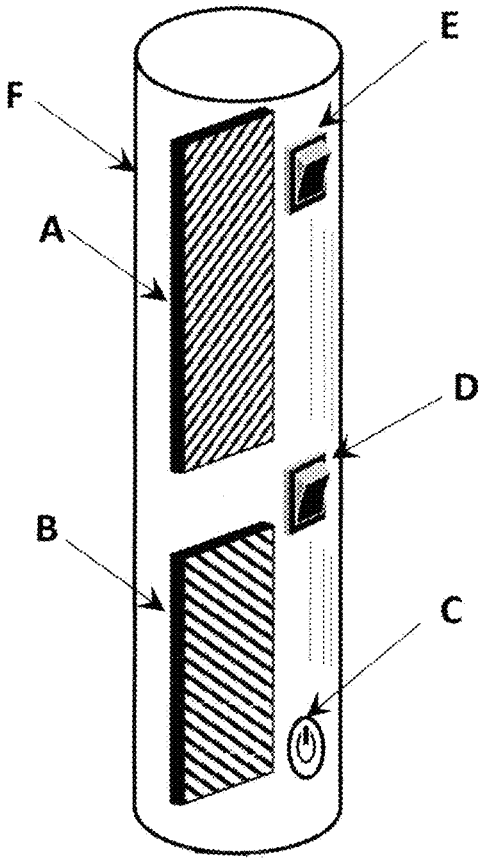
FIG. 3 shows the major components of the invention configured as a portion of the pole of a flagger's stop paddle.

The invention claimed is:

1. A portable traffic control sign for monitoring construction workers, comprising:

a sign having a visual portion connected to a pole for a worker to hold the sign;

a geo-location circuit coupled to the sign to provide location information;

a processor for receiving the location information;

a sensor for determining flagging activity coupled to the processor; and a transmitter coupled to the processor for transmitting the flagging activity, the location information and a sign identifier to a remote traffic data center.

2. The portable traffic control sign in claim 1, wherein the sensor is a magnetometer or an accelerometer.

3. The portable traffic control sign in claim 1, further comprising a switch to input traffic count a number of passing vehicles wherein the processor counts the passing vehicles and transmits the number of counted vehicles to the remote traffic data center.

4. The portable traffic control sign in claim 1, wherein the flagging activity is changing between a slow sign and a stop sign.

5. A traffic monitoring system, comprising:

one or more traffic control signs as recited in claim 1; and a traffic control center for receiving the transmitted information from one or more portable traffic control signs and relaying at least some of the information to a navigation system for automobiles.

6. The traffic monitoring system in claim 5, wherein the relayed information is the location and operating status of the at least one traffic control sign.

* * * * *